US006623253B1

(12) United States Patent
Onoda et al.

(10) Patent No.: US 6,623,253 B1
(45) Date of Patent: Sep. 23, 2003

(54) COMPRESSOR

(75) Inventors: Izumi Onoda, Fuji (JP); Isao Kawabe, Fujinomiya (JP); Hisataka Kato, Fuji (JP)

(73) Assignee: Toshiba Carrier Corporation, Tokyo (JP)

( * ) Notice: Subject to any disclaimer, the term of this patent is extended or adjusted under 35 U.S.C. 154(b) by 4 days.

(21) Appl. No.: 10/048,944

(22) PCT Filed: Aug. 11, 2000

(86) PCT No.: PCT/JP00/05387

§ 371 (c)(1),
(2), (4) Date: Feb. 6, 2002

(87) PCT Pub. No.: WO01/12992

PCT Pub. Date: Feb. 22, 2001

(30) Foreign Application Priority Data

Aug. 11, 1999 (JP) ..... 11-227540

(51) Int. Cl.[7] ..... F04B 39/06; H02K 9/12
(52) U.S. Cl. ..... 417/366; 310/59
(58) Field of Search ..... 310/59; 417/366; 418/55.4, 55.6

(56) References Cited

U.S. PATENT DOCUMENTS 3,146,605 A * 9/1964 Rachfal et al. ..... 417/366
4,552,518 A * 11/1985 Utter ..... 418/55.6
4,958,988 A * 9/1990 Regev ..... 417/366
4,968,228 A 11/1990 Da Costa et al.
5,263,822 A * 11/1993 Fujio ..... 418/55.4
5,345,785 A * 9/1994 Sekigami et al. ..... 418/55.6
5,591,018 A * 1/1997 Takeuchi et al. ..... 417/366

FOREIGN PATENT DOCUMENTS

| | | |
|---|---|---|
| DE | 3804435 A1 | 2/1988 |
| FR | 2 551 143 | 8/1984 |
| JP | 5 260699 | 10/1993 |

* cited by examiner

*Primary Examiner*—Michael Koczo
(74) *Attorney, Agent, or Firm*—Pillsbury Winthrop LLP

(57) ABSTRACT

A compressor comprises a sealed case to which a suction pipe and a discharge pipe are connected, a compression mechanism unit provided within the sealed case, and a motor unit provided within the sealed case, the motor unit comprising a stator and a rotor for driving the compression mechanism unit, a gas passages for passing a gas discharged from the compression mechanism unit are formed in the motor unit, and a ratio of a total area of slot gap portions defined between slots of a stator core and coils in a stator of the motor unit to an entire area of the gas passages is set at 0.3 or more.

13 Claims, 5 Drawing Sheets

COMPRESSOR

This application is the National Phase of International Application PCT/JP00/05387 filed Aug. 11, 2000 which designated the U.S. and that International Application was published under PCT Article 21(2) in English.

TECHNICAL FIELD

The present invention generally relates to a compressor, and more particular to a compressor having a gas passage structure capable of preventing a lubricating oil for lubricating a compression mechanism unit, which mixes into a high-pressure gas compressed by the compression mechanism unit, from being discharged to the outside of a sealed case.

BACKGROUND ART

A compressor for use in, for example, a refrigerator or an air conditioner, has a sealed case to which a suction pipe and a discharge pipe are connected. The sealed case accommodates a compression mechanism unit for compressing a refrigerant, and a motor unit with a stator and a rotor for driving the compression mechanism unit.

A pressurized gas compressed by the compression mechanism unit is temporarily discharged to the sealed case from a discharge port and then guided to gas passages provided in the motor unit. At last, the gas is discharged to an external device from a discharge pipe connected to the sealed case.

On the other hand, an oil reservoir for receiving a lubricating oil for lubricating the compression mechanism unit is formed at an inner bottom portion of the sealed case. The lubricating oil is sucked up in accordance with an operation of the compression mechanism unit. Then, the lubricating oil lubricates the respective slidable elements within the compression mechanism unit and returns to the oil reservoir in a circulating manner.

There is a possibility, however, that part of the lubricating oil in the state of mist (fine particles), which has lubricated the compression mechanism unit, may mix in the pressurized gas, and it may be brought to the gas passages in the motor unit and discharged from the discharge pipe to the external device.

The gas passages in the motor unit comprise gaps between a radially outside portion of the stator and a radially inside portion of the sealed case, through-holes formed in a stator core, slot gap portions between slots of the stator core and coils, an air gap between a radially outside portion of the rotor and a radially inside portion of the stator, and gas holes penetrating a rotor core.

In the prior art, when the gas passages comprising such gaps are designed, no consideration has given to the mutual relationship among the gas passages. For example, the ratio of the total area of the slot gap portions to the entire area of the gas passages (i.e. the total area of slot gap portions/the entire area of gas passages) is about 0.1.

In addition, the area of the slot gap portion associated with each slot is very small, compared to the area of the discharge port for temporarily discharging the compressed high-pressure gas into the sealed case, and the ratio of the slot gap portion (i.e. the area of slot gap portion per slot/the area of discharge port) is about 0.1.

In the above structure, the amount of lubricating oil discharged to the outside from the compressor increases because the lubricating oil in the state of mist mixes into the gas passing through the slot gap portions. Consequently, a sufficient amount of lubricating oil in the oil reservoir cannot be maintained, and the respective slidable elements in the compression mechanism unit may be destroyed.

To solve this problem, Japanese Patent No. 1,468,483, for example, discloses that a high-pressure gas coming up through an air gap is made to impinge upon an upper coil end and a centrifugal separation action is positively utilized to separate oil mist from the high-pressure gas and to return the oil to the oil reservoir at the inner bottom region of the sealed case through a gap existing at the outer periphery of the stator.

In modern air conditioners, in order to save energy and enhance comfortableness, an inverter drive system capable of varying the number of rotations of compressors is dominantly adopted. In this type of apparatuses, the number of rotations for the main driving is kept low once the room temperature is stabilized, but it is increased when the amount of circulating gas increases at the time of, e.g. start-up of driving. As a result, the above-described oil recovery cycle is not ensured.

Specifically, the high-pressure discharged into the sealed case from the discharge port of the compression mechanism unit goes up not only through the air gap between the rotor and stator, but also through the gap between the radially outside portion of the stator and the radially inside portion of the sealed case. Thus, even an oil, which may fall through the latter gap, is blown up and discharged to the outside of the sealed case.

Besides, in the conventional motor unit, the number of slots of the stator is set at a multiple of 3, which is greater than 20 (e.g. 24 slots). If the space factor of coils inserted in the slots is increased to enhance efficiency, little space is left for gas passages in the slots. It is also difficult to increase the air gap because the performance of the motor unit needs to be maintained at a sufficient level.

DISCLOSURE OF INVENTION

The object of the present invention is to provide a compressor with high reliability, which can reduce as much as possible a leakage of lubricating oil to the outside of the compressor and can always maintain a predetermined amount of lubricating oil in an oil reservoir formed at an inner bottom region of a sealed case, thereby realizing stable oil supply.

The present invention provides a compressor wherein a sealed case to which a suction pipe and a discharge pipe are connected accommodates a compression mechanism unit and a motor unit having a stator and a rotor for driving the compression mechanism unit, gas passages for passing a gas discharged from the compression mechanism unit are formed in the motor unit, and a ratio of a total area of slot gap portions defined between slots of a stator core and coils in a stator of the motor unit to an entire area of the gas passages is set at 0.3 or more.

According to the present invention, a leakage of lubricating oil to the outside of the compressor can be reduced as much as possible, and a predetermined amount of lubricating oil can always be maintained in the oil reservoir formed at the inner bottom region of the sealed case.

BEST MODE FOR CARRYING OUT THE INVENTION

Embodiments of the present invention will now be described with reference to the accompanying drawings.

Figure 1:
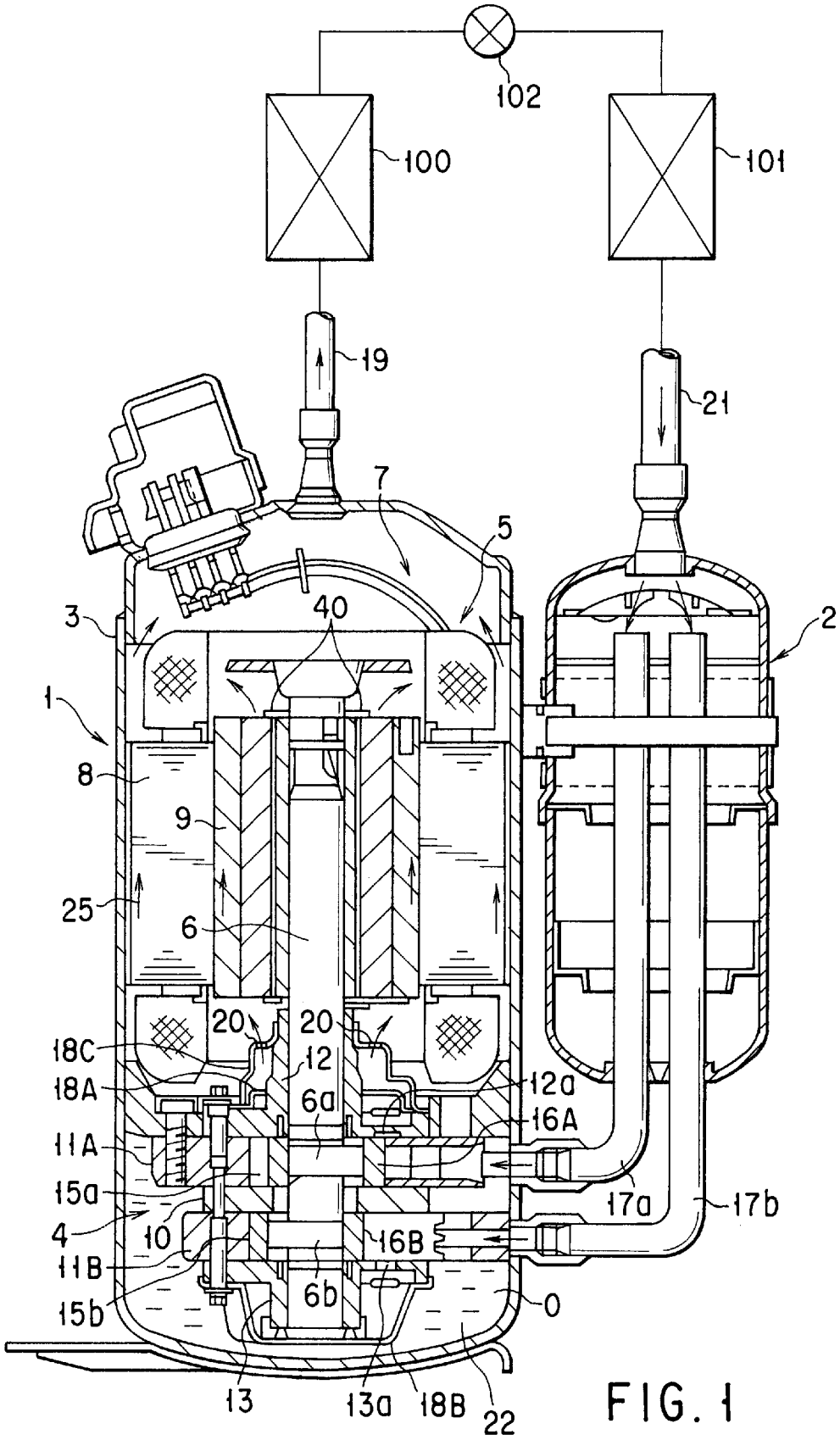
FIG. 1 is a vertical cross-sectional view showing a compressor according to a first embodiment of the present invention and an accumulator.

FIG. 1 is a vertical cross-sectional view showing a compressor 1 according to a first embodiment of the present invention and an accumulator 2. The compressor has a sealed case 3. A compression mechanism unit 4 is accommodated in a lower region of the sealed case 3. A motor unit 5 is provided in an upper region of the sealed case 3. The compression mechanism unit 4 and motor unit 5 are coupled by means of a rotary shaft 6.

The motor unit 5 comprises a stator 8 and a rotor 9. The stator 8 is fixed on an inner surface of the sealed case 3. The rotor 9 is disposed inside the stator 8 with a predetermined gap provided therebetween. The rotary shaft 6 is inserted in the rotor 9.

Gas passages 25 defined by a plurality of gaps are formed to penetrate from an upper surface to a lower surface of the motor unit 5. The gas passages 25 guide a high-pressure gas, which is compressed by the compression mechanism unit 4 and discharged into the sealed case 3. The gas passages 25 will be described later in greater detail.

The compression mechanism unit 4 comprises an upper cylinder 11A and a lower cylinder 11B which are vertically arranged, with a partition plate 10 interposed. The partition plate 10 is provided at a lower part of the rotary shaft 6. The upper cylinder 11A has an upper surface portion fixed to a primary bearing 12. The lower cylinder 11B has a lower surface portion fixed to a secondary bearing 13.

The upper and lower surfaces of the cylinders 11A and 11B are bounded by the partition plate 10, primary bearing 12 and secondary bearing 13, and cylinder chambers 15*a* and 15*b* are defined within the cylinders 11A and 11B, respectively. So-called rotary compression mechanisms 16A and 16B are constituted in the cylinder chambers 15*a* and 15*b*, respectively. In each rotary compression mechanism, a roller is eccentrically driven in accordance with the rotation of the rotary shaft 6, and the cylinder chamber is divided by vanes into a high-pressure portion and a low-pressure portion.

The primary bearing 12 and secondary bearing 13 have discharge ports 12*a* and 13*a*, respectively. The discharge ports 12*a* and 13*a* are covered with valve covers 18A and 18B. High-pressure gas discharged into the valve covers 18A and 18B is guided into a valve cover 18C.

The valve cover 18C is provided with discharge ports 20 for discharging the gas into the sealed case. The cylinder chambers 15*a* and 15*b* in both cylinders 11A and 11B are made to communicate with the accumulator 2 via conduits 17*a* and 17*b*.

An oil reservoir 22 for receiving a lubricating oil O is formed at an inner bottom region of the sealed case 3. The lubricating oil O is any one of ether oil, ester oil and alkyl-benzene oil.

On the other hand, a refrigerant discharge pipe 19 is connected to an upper surface portion of the sealed case 3. The sealed case 3 is made to communicate with a condenser 100 over the pipe 19. A refrigerant suction pipe 21 is connected to an upper surface portion of the accumulator 2. The accumulator 2 is made to communicate with an evaporator 101 over the pipe 21. An expansion mechanism 102 is connected between the condenser 100 and evaporator 101. Thus, a refrigerating cycle comprising the compressor 1, condenser 100, expansion mechanism 102, evaporator 101 and accumulator 2, which are successively connected in the named order, is constituted. The refrigerant is any one of HCFC refrigerant, HFC refrigerant and HC refrigerant.

The operation of the compressor 1 will now be described.

Arrows in FIG. 1 indicate the flow of gas. A low-pressure gas is sucked into the compression mechanism unit 4 of compressor 1 from the accumulator 2 over the conduits 17*a* and 17*b*. The low-pressure gas is compressed in the cylinder chambers 15*a* and 15*b*, and the resultant high-pressure gas flows through the discharge ports 12*a* and 13*a* and valve covers 18A and 18B into the valve cover 18C. From the valve cover 18C, the high-pressure gas is discharged into the sealed case 3 via the discharge ports 20.

The high-pressure gas flows from the upper part of the compression mechanism unit 4 to the motor unit 5. The high-pressure gas is then guided through the gas passages 25 formed in the motor unit 5, thus filling the inner space of the sealed case 3 above the motor unit 5. The gas is discharged from within the compressor 1 to the outside through the discharge pipe 19 connected to the upper end portion of the sealed case 3, and thus guided to the condenser 100 in the refrigerating cycle.

On the other hand, the lubricating oil O in the oil reservoir 22 at the inner bottom portion of the sealed case 3 is sucked up into the compression mechanism unit 4 in accordance with the compression action of the refrigerant gas, thereby lubricating the respective slidable elements. Then, the lubricating oil O flows down and returns to the oil reservoir 22.

Most of the lubricating oil O circulates, as described above, but part of the oil O is blown up from the compression mechanism unit 4 along with the high-pressure gas. The blown-up oil O in the state of mist (fine particles) mixes in the high-pressure gas and flows into the gas passages 25 provided in the motor unit 5.

If the oil mist passes through the gas passages in the motor unit 5, it may possibly be discharged out of the compressor 1 along with the high-pressure gas. In order to solve this problem, the structure of the motor unit 5, in particular, of the stator 8, as well as the gas passages 25, are improved in the present invention. Thereby, the high-pressure gas alone is smoothly let to flow, while the passage of particles (mist) of lubricating oil is prevented as much as possible.

Figure 5:
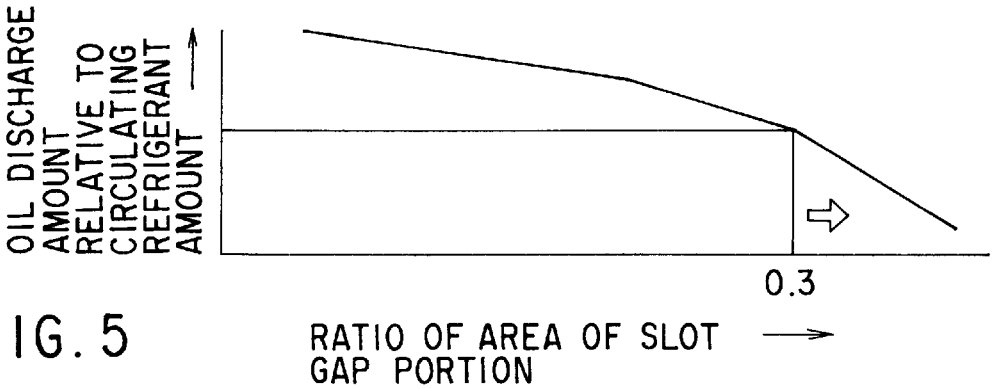
FIG. 5 is a characteristic graph showing a variation in the relationship between the ratio of the area of slot gap portions, on the one hand, and the discharge oil amount relative to the refrigerant circulation amount, on the other.

FIG. 5 is a characteristic graph showing experimental results relating to the variation in the relationship between the ratio of the total area of slot gap portions to the entire area of gas passages, on the one hand, and the discharge oil amount relative to the refrigerant circulation amount, on the other, under specified conditions of driving of the compressor 1. It is understood from the experimental results that if the ratio of the total area of slot gap portions is 0.3 or more, the oil discharge amount can be reduced. If it is less than 0.3, the oil discharge amount increases and the supply of lubricating oil to the compression mechanism unit decreases. As a result, the possibility of mechanical damage increases, and the lubricating oil discharged to the external device and connection pipes may adhere there. Consequently, the performance of the compressor will deteriorate.

Figure 6:
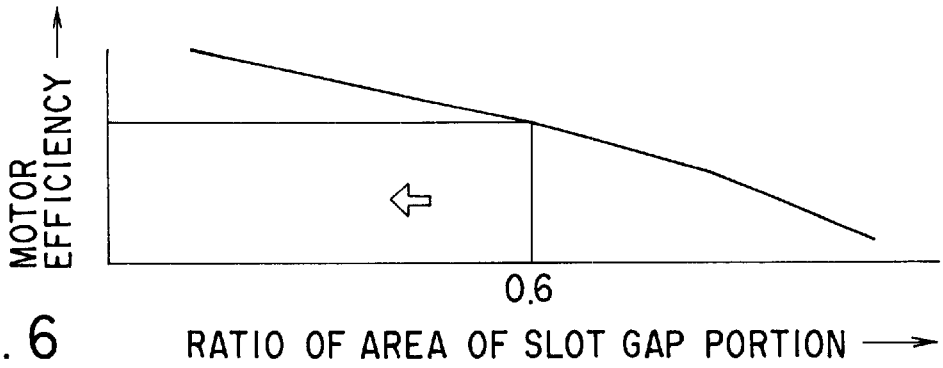
FIG. 6 is a characteristic graph showing a variation in the relationship between the ratio of the area of slot gap portions, on the one hand, and the motor efficiency, on the other.

FIG. 6 is a characteristic graph showing a variation in the relationship between the ratio of the total area of slot gap portions to the entire area of gas passages, on the one hand, and the motor efficiency, on the other. As the ratio of the total area of slot gap portions increases, the oil discharge amount decreases but the motor efficiency deteriorates. If this ratio is 0.6 or less, a high motor efficiency can be maintained. However, if the ratio exceeds 0.6, the ratio of area occupied by the coils in the motor unit decreases excessively. Consequently, the motor efficiency decreases and the performance of the compressor deteriorates. From the experimental result, it is desirable that the ratio should be in a range of 0.3 to 0.6.

Figures 2A, 2B:
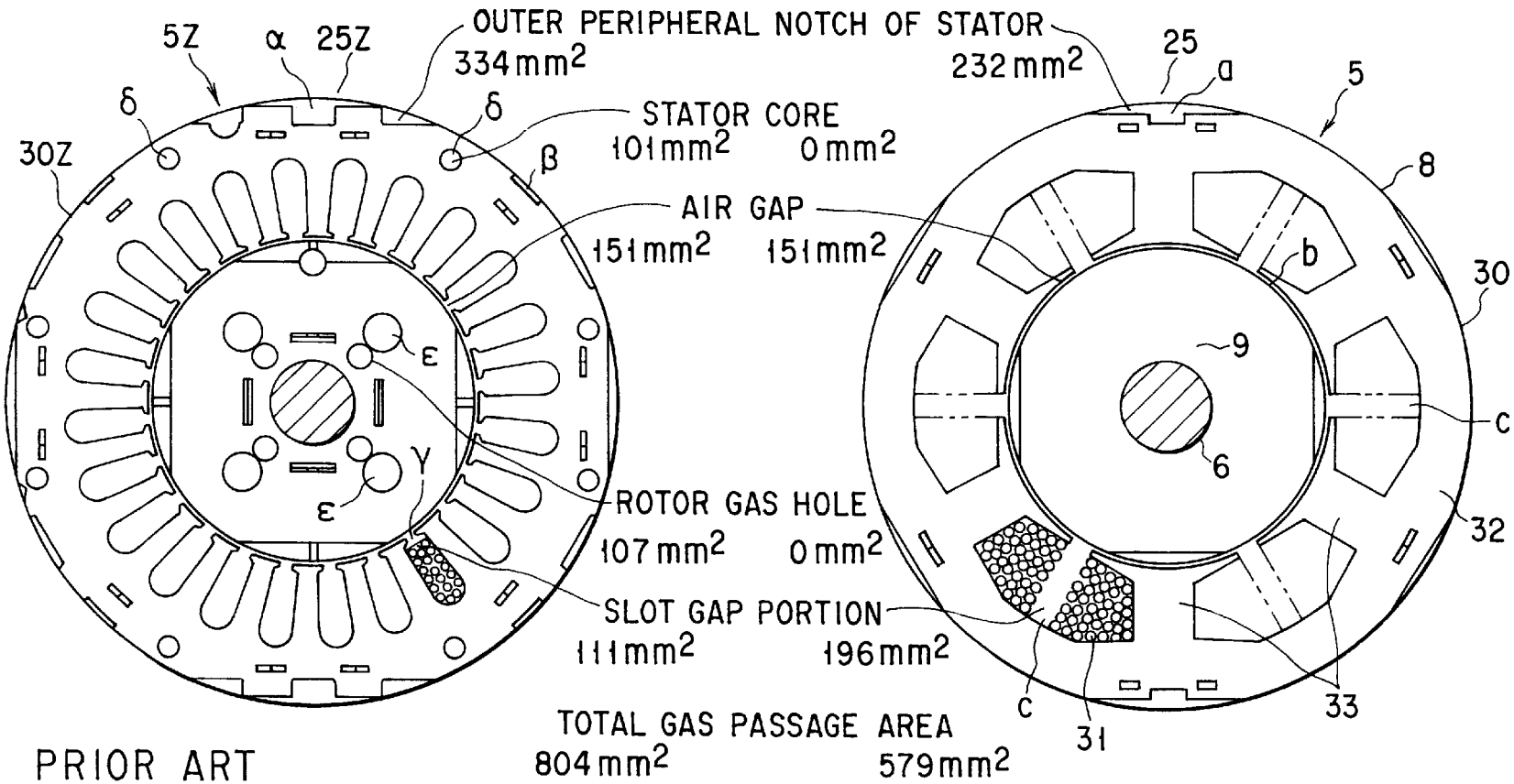
FIG. 2A is a horizontal cross-sectional view showing a motor unit built in the compressor.
FIG. 2B is a horizontal cross-sectional view showing a motor unit built in a conventional compressor, as compared to the compressor according to the first embodiment.
Figure 3:
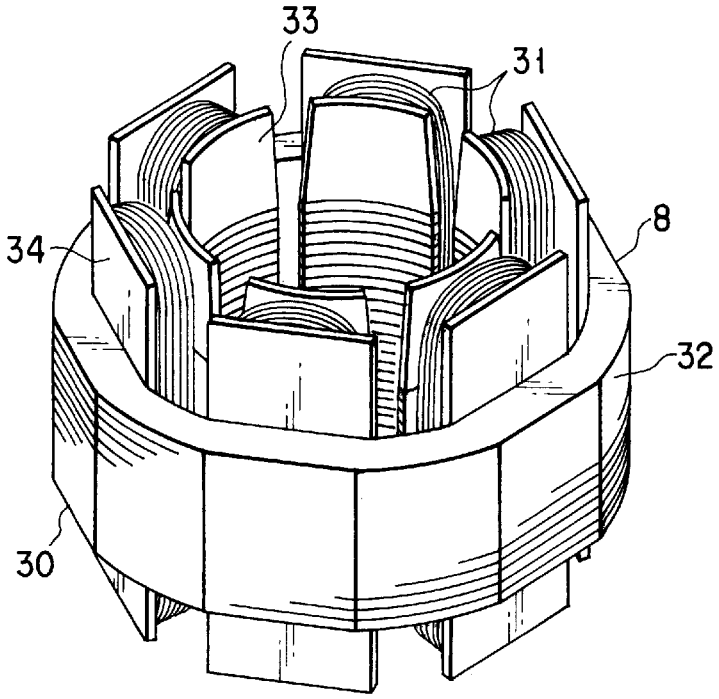
FIG. 3 is a perspective view showing a main part of the motor unit built in the compressor according to the first embodiment.

FIG. 2A is a horizontal cross-sectional view showing the motor unit 5 according to the first embodiment of the invention, and FIG. 2B is a horizontal cross-sectional view showing a motor unit 5Z as a comparative example. To begin with, the structure of the motor unit 5 of this invention will be described. FIG. 3 is a perspective view showing a main part of the stator 8 built in the motor unit 5.

The stator 8 has a stator core 30 formed of laminated steel plates. The stator core 30 comprises an annular yoke section 32 and a plurality (six) of teeth portions 33. The teeth portions 33 are formed integral to the inside of the yoke section 32 and disposed in a radial fashion at predetermined intervals from one another.

Each teeth portion 33 is coated with an insulating member 34. With the insulating member 34 interposed, a coil 31 is wound on the teeth portion 33. The respective elements are designed such that a predetermined gap is provided in this state between the coils 31 of adjacent teeth portions 33 and the stator core 30. This gap is referred to as a slot gap portion c. The insulating members 34 for the coils 31 are circumferentially disposed at positions between the inside portion including the slot gap portions c of stator 8 and a boundary of the outer periphery of the stator 8 and the inner periphery of the sealed case 3.

The gas passages 25 in the motor unit 5 for passing the high-pressure gas discharged from the compression mechanism unit 4 comprise gaps a provided between notches at the outer periphery of the stator 8 and the inner periphery of the sealed case 3, an air gap b provided between the inner periphery of the stator 8 and the outer periphery of the rotor 9, and the above-described slot gap portions c.

Since six teeth portions 33 are provided, six slots are formed and accordingly six slot gap portions c are formed. In particular, no through-hole is formed in the stator core 30, nor is a gas hole formed in the rotor 9.

Actual design specifications are as follows. The total area of the notches a at the outer periphery of the stator 8 is 232 $mm^2$. Since no hole is formed in the stator core 30, the area of such a hole is 0 $mm^2$. The area of the air gap b between the rotor 9 and stator 8 is 151 $mm^2$. Since no gas hole is formed in the rotor 9, the area of such a hole is 0 $mm^2$. The total area of the slot gap portions c is 196 $mm^2$ at the minimum.

Accordingly, the entire area of gas passages 25 in the motor unit is 579 $mm^2$, and the total area of the slot gap portions c is 196 $mm^2$. Thus, the ratio of the total area of the slot gap portions c to the entire area of the gas passages 25 (i.e. the total area of slot gap portions/the entire area of gas passages) is about 0.34.

On the other hand, the conventional motor unit 5Z shown in FIG. 2B as a comparative example has such gas passages 25Z as described below.

The total area of notches $\alpha$ at the outer periphery of the stator is 334 $mm^2$. The total area of through-holes $\delta$ formed in a stator core 30Z is 101 $mm^2$. The area of an air gap $\beta$ is 151 $mm^2$. The total area of gas holes $\epsilon$ penetrating the rotor is 107 $mm^2$. The total area of 24 slot gap portions $\gamma$ is 111 $mm^2$.

Accordingly, the entire area of gas passages 25Z in the conventional motor unit 5Z is 804 $mm^2$. Thus, the ratio of the total area of the slot gap portions $\gamma$ to the entire area of the gas passages 25Z is only about 0.14.

By contrast, in the case of the structure of the motor unit 5 of this invention, the ratio of the total area of the slot gap portions c to the entire area of the gas passages 25 is about 0.34. Specifically, since the ratio of the area of the slot gap portions becomes such greater than in the conventional structure, the flow rate V of the high-pressure gas passing through the slot gap portions c greatly decreases, compared to the conventional structure. As a result, the amount of oil blown up from the slot gap portions c decreases. In this case, the lubricating oil blown up from the motor unit 5 may easily fall to the lower side of the motor unit 5 because of the above-described structure. As a result, the amount of oil discharged out of the compressor 1 decreases, and the amount of oil in the oil reservoir 22 is always sufficiently maintained. Since a sufficient amount of lubricating oil is always supplied to the respective slidable elements in the compression mechanism unit 4, smooth operations of these elements are ensured with high reliability.

Experimental results below were obtained with the driving of the compressors having the motor units 5 and 5Z shown in FIGS. 2A and 2B.

Figure 4:
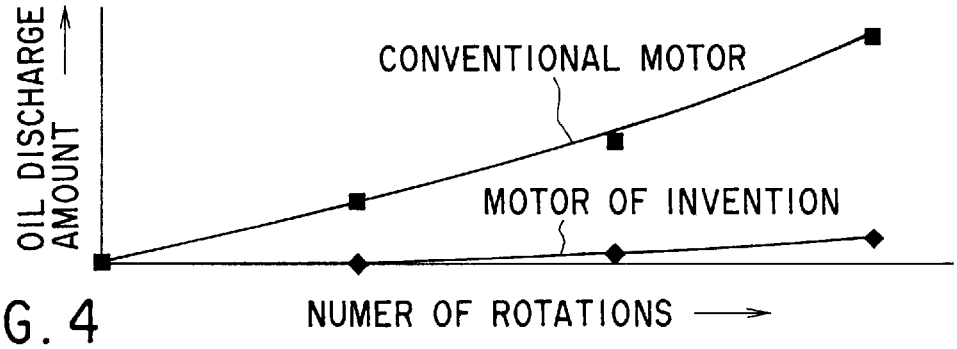
FIG. 4 is a characteristic graph showing a variation in the relationship between the number of rotations of the compressor and the oil discharge amount.

FIG. 4 shows comparative data on the relationship between the number of rotations and the amount of lubricating oil discharged to the outside, with respect to the compressor 1 having the motor unit 5 according to the present invention and the compressor having the conventional motor unit 5Z.

In the case of the compressor with the conventional motor unit 5Z, the oil discharge amount increases substantially in proportion to the number of rotations. By contrast, in the case of the compressor 1 having the motor unit 5 of this invention, the oil discharge amount remains small even if the number of rotations increases. Therefore, the compressor 1 having the motor unit 5 of this invention is very efficient.

As has been described above, in the case of the structure of the motor unit 5 of this invention, the ratio of the total area of the slot gap portions c to the entire area of the gas passages 25 is about 0.34. On the other hand, in the case of the conventional motor unit 5Z, this ratio is 0.14. No problem arises with the structure of the present invention, but the above-described drawback becomes conspicuous in the conventional structure.

In the case of the structure of the conventional motor unit 5Z, the total area of 24 slot gap portions γ is 111 $mm^2$ and the 24 slots are provided. Accordingly, the area of the slot gap portion associated with one slot is 4.5 $mm^2$. On the other hand, the area of the discharge port 12*a*, 13*a* formed in the compression mechanism unit 4 is 56 $mm^2$ (equal between the structure of the present invention and the structure of the prior art), and the ratio of the area of the discharge port, i.e. 56 $mm^2$, to the area of the slot gap portion associated with one slot, i.e. 4.5 $mm^2$, is 0.08.

In the case of the motor unit 5 of this invention, the six slots are provided and the ratio of the area of the discharge port to the area of the slot gap portion associated with one slot is 0.58.

Figure 7:
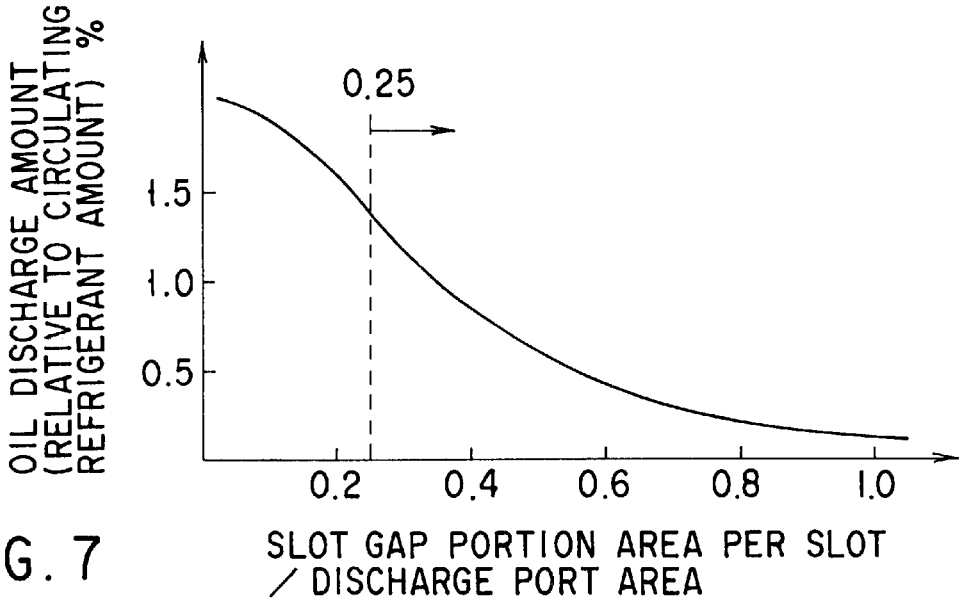
FIG. 7 is a characteristic graph showing a variation in the relationship between the ratio of the area of a slot gap portion associated with each slot to the area of the discharge port, on the one hand, and the oil discharge amount, on the other.

FIG. 7 is a characteristic graph showing a variation in the relationship between the ratio of the area of the slot gap portion c associated with each slot to the area of the discharge port, on the one hand, and the amount of lubricating oil discharged to the outside in relation to the amount of circulating refrigerant, on the other. It is understood from FIG. 7 that the oil discharge amount is large where the ratio of the area of the slot gap portion c associated with each slot to the area of the discharge port is in a range between 0 and 0.25. The oil discharge amount, however, remarkably decreases in the range exceeding 0.25, and a complex oil separation function, etc. is not required. This means that in consideration of the surface tension of the lubricating oil O, in order to prevent the lubricating oil from being blown up to the motor unit, it is more effective to increase the cross-sectional area of each gas passage than to provide many small-area passages.

It is generally thought that the oil discharge amount should preferably be 1.5% or less, in consideration of maintenance of oil level in the oil reservoir 22 and adhesion of lubricating oil film on the external device and connection pipes. Accordingly, it is desirable that the ratio of the area of the slot gap portion associated with each slot to the area of the discharge port be set at 0.25 or more. By setting this ratio at 0.25 or more, the blowing up of lubricating oil can effectively be prevented.

Figure 8:
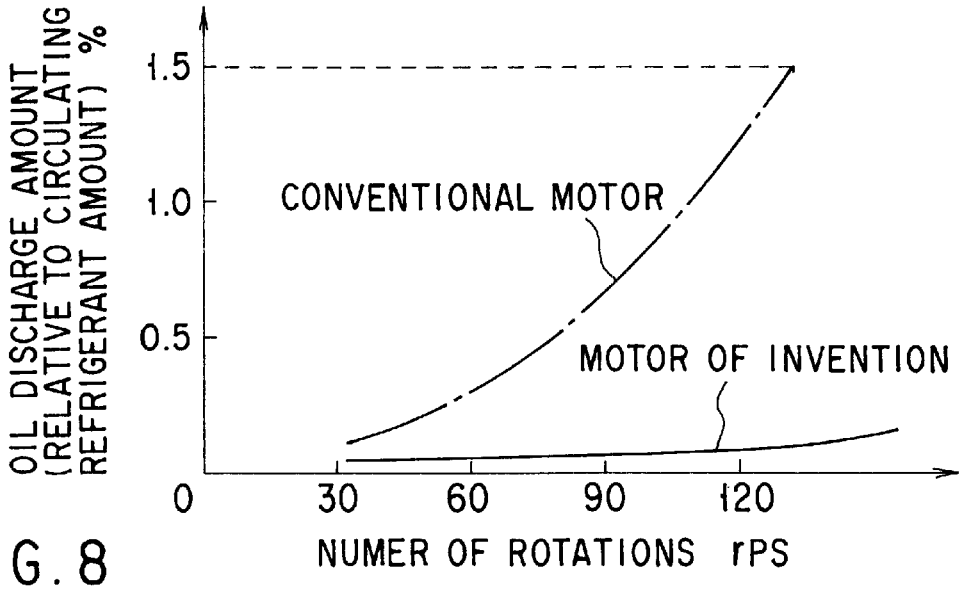
FIG. 8 is a characteristic graph showing variations in the relationship between the number of rotations and the oil discharge amount in the compressor according to the first embodiment of the invention and the conventional compressor.

FIG. 8 is a characteristic graph showing variations in the relationship between the number of rotations of the rotary shaft 6 and the oil discharge amount (relative to the amount of circulating refrigerant) in the compressor according to the first embodiment of the invention and the conventional compressor. Where the ratio of the cross-sectional area of the discharge port 12*a*, 13*a* to the area of the slot gap portion c associated with one slot in the motor unit 5 of the present invention is 0.58, the ratio of the oil discharge amount of the present invention is compared to the ratio of the oil discharge amount of the conventional motor unit 5Z.

As the number of rotations increases, the difference in oil discharge amount increases. When the number of rotations is 120 rps, the ratio of oil discharge amount in the motor unit 5 decreases to about 1/20 or less, compared to the conventional motor unit 5Z. It is understood that the motor unit 5 of this invention is very efficient.

As mentioned above, the coil 31 is wound around each teeth portion 33 constituting the stator core 30, with the insulating member 34 interposed. An outermost portion of the insulating member 34 is formed at higher level than the other portions.

On the other hand, as shown in FIG. 1, heads of pins 40 for fixing the structural components project at the upper end of the rotor 9. In addition, the position of the discharge ports 20 in the valve cover 18C is set to be inside the outermost portion of the insulating member 34.

Besides, a total area A of gas passages in the motor unit 5 is a sum of an inside area A1 including a total area of slot gap portions c, and an area A2 including an area of notches a at the outer periphery of the stator and, where a hole portion is formed near the outer periphery of the stator, the area of this hole portion (A=A1+A2), and A1>A2.

The high-pressure gas discharged from the compression mechanism unit 4 passes through the motor unit 5. In this case, with the above-described structure, the high-pressure gas passes mainly through the slot gap portions c of the stator 8, which are less affected by the rotation of the rotor 9.

Specifically, since the main stream of high-pressure gas does not flow through the air gap b between the rotor 9 and stator 8, there will occur neither variation in flow rate nor reduction in size of flowing lubricating oil particles due to the rotation of the rotor 9.

Owing to disturbance (centrifugal force) of gas occurring near the heads of pins 40 projecting at the upper end of the rotor 9, a rising gas with a low flow velocity is affected by a force in a radially outward direction, too. Oil particles with heavy weight returns to the oil reservoir 22 at the inner bottom portion of the sealed case 3 through the outside passage area A2 including the area of notches a at the outer periphery of the stator and, where a hole portion is formed near the outer periphery of the stator 8, the area of this hole portion. Accordingly, particles of the lubricating oil smoothly return to the oil reservoir 22. Where a disc (an oil component separation plate) is provided at the upper end of the rotor 9, a greater effect can be brought about.

As has been described above, the advantages of the compressor of the present invention reside in the enhancement of lubrication and reliability of the compressor due to reduction in oil discharge amount. Even in the refrigerating cycle, the heat exchange performance can be increased by virtue of the reduction in lubricating oil adhering to the inner walls of the at heat exchangers (condenser, evaporator).

Figure 9:
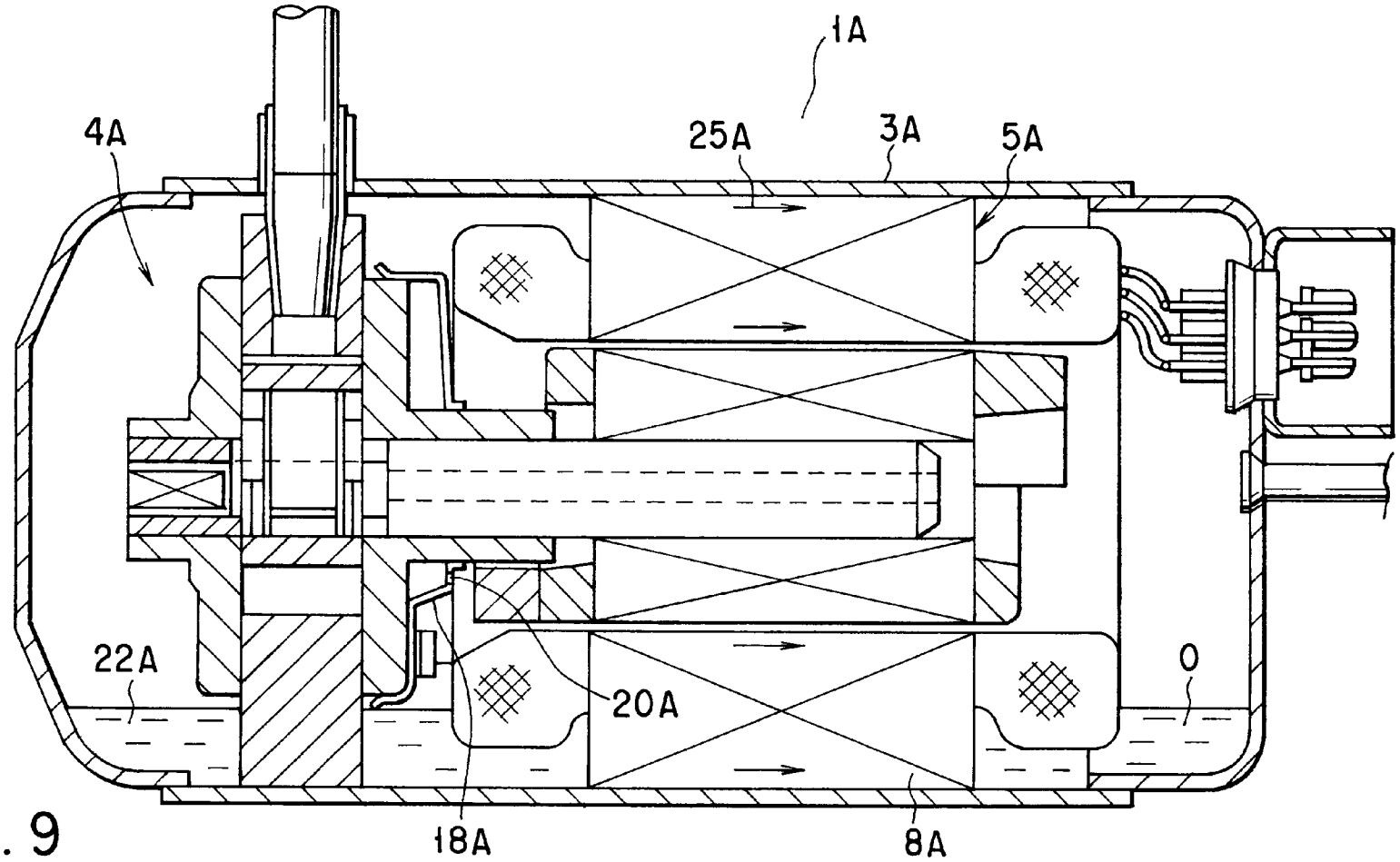
FIG. 9 is a vertical cross-sectional view showing a horizontal-type compressor according to a second embodiment of the present invention.

The above-described structure of the compressor can be applied to a horizontal-type compressor 1A, as shown in FIG. 9. The position of a discharge port 20A formed in a compression mechanism unit 4 is located inside an outermost portion of an insulating member 34 fitted in the teeth portion of a stator 8A. Thus, the discharge gas does not disturb the oil level and passes through the slot gap portions (not shown).

Since the compressor 1A is of the horizontal type, the outer periphery of a motor unit 5A is located at the bottom of a sealed case 3A where an oil reservoir 22A is formed. Accordingly, the motor unit 5A is cooled by the lubricating oil O. Moreover, since the part immersed in the lubricating oil O maintains gas passages 25A, the lubricating oil level in the oil reservoir 22A can be stabilized. In particular, in the case of the horizontal-type compressor, it is more difficult to maintain a sufficient distance between the rotor 9A and the oil level in the oil reservoir 22A, than in the case of the above-described vertical-type compressor. Therefore, the use of this structure is very effective.

As has been described above, according to the compressor of the present invention, a leakage of lubricating oil to the outside of the compressor can be reduced as much as possible, and a predetermined amount of lubricating oil can always be maintained in an oil reservoir formed at an inner bottom region of a sealed case, thereby realizing stable oil supply and enhancing reliability.

What is claimed is:

1. A compressor comprising:

a sealed case to which a suction pipe and a discharge pipe are connected;

a compression mechanism unit provided within the sealed case; and a motor unit provided within the sealed case, the motor unit comprising a stator and a rotor for driving the compression mechanism unit, wherein gas passages for passing a gas discharged from the compression mechanism unit are formed in the motor unit, and a ratio of a total area of slot gap portions defined between slots of a stator core and coils in a stator of the motor unit to an entire area of the gas passages is set at 0.3 or more.

2. A compressor comprising:

a sealed case to which a suction pipe and a discharge pipe are connected;

a compression mechanism unit provided within the sealed case; and a motor unit provided within the sealed case, the motor unit comprising a stator and a rotor for driving the compression mechanism unit, wherein an area of each of slot gap portions defined between slots of a stator core and coils in a stator of the motor unit, said each of slot gap portions being associated with one slot, is set to be more than 0.25 times greater than an area of a discharge port formed in the compression mechanism unit and discharging and guiding a high-pressure gas into the sealed case.

3. A compressor comprising:

a sealed case to which a suction pipe and a discharge pipe are connected;

a compression mechanism unit provided within the sealed case; and a motor unit provided within the sealed case, the motor unit comprising a stator and a rotor for driving the compression mechanism unit, wherein gas passages for passing a gas discharged from the compression mechanism unit are formed in the motor unit, and a total area A of the gas passages is a sum of an inside area A1 including a total area of slot gap portions defined between slots of a stator core and coils in a stator of the motor unit, and an area A2 including an area of passages between an outer periphery of the stator and an inner periphery of the sealed case and, where a hole portion is formed near the outer periphery of the stator, the area of this hole portion (A=A1+A2), and A1>A2.

4. A compressor according to claim 1, wherein the area of the slot gap portion associated with one slot is set to be more than 0.25 times greater than an area of a discharge port formed in the compression mechanism unit and discharging and guiding a high-pressure gas into the sealed case.

5. A compressor according to claim 1, wherein a total area A of the gas passages is a sum of an inside area A1 including the total area of the slot gap portions in the stator, and an area A2 including an area of passages between an outer periphery of the stator and an inner periphery of the sealed case and, where a hole portion is formed near the outer periphery of the stator, the area of this hole portion (A=A1+A2), and A1>A2.

6. A compressor according to claim 2, wherein, a total area A of the gas passages is a sum of an inside area A1 including the total area of the slot gap portions in the stator, and an area A2 including an area of passages between an outer periphery of the stator and an inner periphery of the sealed case and, where a hole portion is formed near the outer periphery of the stator, the area of this hole portion (A=A1+A2), and A1>A2.

7. A compressor according to claim 4, wherein a total area A of the gas passages is a sum of an inside area A1 including the total area of the slot gap portions in the stator, and an area A2 including an area of passages between an outer periphery of the stator and an inner periphery of the sealed case and, where a hole portion is formed near the outer periphery of the stator, the area of this hole portion (A=A1+A2), and A1>A2.

8. A compressor according to claim 1, wherein a ratio of the total area of the slot gap portions to the entire area of the gas passages in the motor unit is 0.6 or less.

9. A compressor according to claim 3, wherein insulating members for the coils are circumferentially disposed at such positions as to separate an inside portion including the slot gap portions in the stator, the outer periphery of the stator, and the inner periphery of the sealed case.

10. A compressor according to any one of claims 1, 2 and 3, wherein the motor unit is of a so-called concentrated-winding type in which the coils are directly wound around teeth portions constituting the stator core, with insulating members interposed, and the number of slots of the stator is set at 6 or 12.

11. A refrigerating apparatus comprising a compressor, a condenser, an expansion mechanism and an evaporator, wherein the compressor is of a type in which the number of rotations is variable, and the compressor has the structure recited in claim 1, and the compression mechanism unit compresses any one of HCFC refrigerant, HFC refrigerant and HC refrigerant, and any one of ether oil, ester oil and alkyl-benzene oil is used as a lubricating oil.

12. A refrigerating apparatus comprising a compressor, a condenser, an expansion mechanism and an evaporator, wherein the compressor is of a type in which the number of rotations is variable, and the compressor has the structure recited in claim 2, and the compression mechanism unit compresses any one of HCFC refrigerant, HFC refrigerant and HC refrigerant, and any one of ether oil, ester oil and alkyl-benzene oil is used as a lubricating oil.

13. A refrigerating apparatus comprising a compressor, a condenser, an expansion mechanism and an evaporator, wherein the compressor is of a type in which the number of rotations is variable, and the compressor has the structure recited in claim 3, and the compression mechanism unit compresses any one of HCFC refrigerant, HFC refrigerant and HC refrigerant, and any one of ether oil, ester oil and alkyl-benzene oil is used as a lubricating oil.

* * * * *